US005493742A

United States Patent [19]

Klearman

[11] Patent Number: 5,493,742

[45] Date of Patent: Feb. 27, 1996

[54] VENTILATING AIR MATTRESS WITH AN INFLATING QUILTED PAD

[75] Inventor: Jeffrey D. Klearman, St. Louis, Mo.

[73] Assignee: Lake Medical Products, Inc., St. Louis, Mo.

[21] Appl. No.: 240,228

[22] Filed: May 10, 1994

[51] Int. Cl.[6] ..... A47C 27/08; A61G 7/04

[52] U.S. Cl. ..... 5/423; 5/453; 5/469; 5/914; 5/470; 5/500

[58] Field of Search ..... 5/453, 468, 469, 5/470, 499, 500, 914, 423

[56] References Cited

U.S. PATENT DOCUMENTS

| | | | |
|---|---|---|---|
| 486,696 | 11/1892 | Curlin . | |
| 818,321 | 4/1906 | Whall . | |
| 1,154,776 | 9/1915 | Joseph . | |
| 1,291,036 | 1/1919 | Linman . | |
| 2,383,592 | 8/1945 | Davis . | |
| 2,596,547 | 5/1952 | Guest . | |
| 2,959,793 | 11/1960 | Bell et al. . | |
| 3,428,974 | 2/1969 | Stuart . | |
| 3,653,083 | 4/1972 | Lapidus | 5/469 |
| 3,678,520 | 7/1972 | Evans | 5/453 |
| 3,780,388 | 12/1973 | Thomas et al. . | |
| 3,790,975 | 2/1974 | Philipp et al. . | |
| 4,057,861 | 11/1977 | Howorth | 5/468 |
| 4,317,244 | 3/1982 | Balfour-Richie | 5/500 X |
| 4,347,633 | 9/1982 | Gammons et al. | 5/453 |
| 4,537,594 | 8/1985 | Fleet et al. . | |
| 4,631,767 | 12/1986 | Carr et al. | 5/453 X |
| 4,644,597 | 2/1987 | Walker . | |
| 4,768,249 | 9/1988 | Goodwin . | |
| 4,944,060 | 7/1990 | Peery et al. | 5/469 X |
| 5,016,304 | 5/1991 | Ryhiner . | |
| 5,031,260 | 7/1991 | LaBianco . | |
| 5,090,077 | 2/1992 | Caden et al. . | |
| 5,117,519 | 6/1992 | Thomas | 5/500 |
| 5,168,589 | 12/1992 | Stroh et al. . | |
| 5,216,768 | 6/1993 | Bodine et al. . | |
| 5,243,725 | 9/1993 | Fowler . | |
| 5,249,318 | 10/1993 | Loadsman . | |
| 5,249,319 | 10/1993 | Higgs | 5/453 |
| 5,267,363 | 12/1993 | Volk | 5/453 |
| 5,285,542 | 2/1994 | West et al. | 5/500 |
| 5,305,483 | 4/1994 | Watkins . | |
| 5,373,595 | 12/1994 | Johnson et al. | 5/470 X |

FOREIGN PATENT DOCUMENTS

| | | |
|---|---|---|
| 1545806 | 5/1979 | United Kingdom . |

*Primary Examiner*—Michael F. Trettel
*Attorney, Agent, or Firm*—Rogers, Howell & Haferkamp

[57] ABSTRACT

A ventilating air mattress includes a mattress cover having a down filled quilted upper portion overlying the upper surface of the mattress such that air escaping from the ventilating air mattress inflates the quilted portion. The differential air pressure drop across the upper and lower layers of the quilted portion of the mattress pad provides a pillowing or fluffing effect which increases the comfort for the user thereof. An air pump with remote control provides user adjustability of the firmness of the mattress. Alternate embodiments include a readily changeable mattress cover or sheet with quilting instead of the quilted mattress pad.

17 Claims, 1 Drawing Sheet

VENTILATING AIR MATTRESS WITH AN INFLATING QUILTED PAD

FIELD OF THE INVENTION

This invention relates to an assembly for a ventilating air mattress with an inflating quilted pad.

SUMMARY OF THE INVENTION

Ventilating air mattresses have been developed and are used in the medical field to minimize bed sores and blisters experienced by people confined to bed for extended lengths of time. Mattresses are known which accept pressurized air through an aperture and have a plurality of pores through their top surfaces allowing a controlled flow of air therethrough. These mattresses advance two primary purposes. First, the controlled air flow allows the mattress firmness to be adjusted thereby distributing the support of a patient over a greater area of the patient's body and relieving pressure in areas most susceptible to bed sores. Second, the controlled air flow assists in drying perspiration moisture which aggravates the bed sore problem.

As the beneficial purposes of the air mattress at least partially rely on the flow of air through the mattress and into contact with the patient, mattress covers, sheets, pads, and the like generally found in the prior art are single layer, vapor permeable coverings. However, there are in some instances in the prior art where greater protection from bodily fluid contamination is desired such that the coverings are also single layer but are liquid impervious. For example, Bodine et al U.S. Pat. 5,216,768 discloses an air mattress and bed structure having a vapor permeable mattress pad which may be made of a microporous polyurethane-coated nylon fabric. Presumably, a liquid impervious yet vapor permeable material is taught as best suited for covering the air mattress. In Caden et al U.S. Pat. 5,090,077, an upper cover panel is disclosed having a layer of absorbent material which is capable of wicking away moisture such as perspiration from the patient by capillary action. The moisture is then removed from the absorbent panel by the air flowing upwardly from the mattress. The cover is taught to be much like a fitted sheet which surrounds the mattress. The inventors herein are also aware of a prior art air mattress cover which is a single layer of nylon which has a tendency to inflate from the pressurized air escaping from the mattress. This device is designed to more completely protect the air loss mattress from contamination from bodily fluids.

Conventional bedding such as down comforters, down mattress pads, covers, fitted sheets, and the like are also well known in the prior art for residential, nonmedical and medical usage. Many examples of these abound, including U.S. Pat. No. 2,383,592, U.S. Pat. No. 2,596,547, and U.S. Pat. No. 5,243,725. These bedding materials are primarily designed for comfort, warmth, ready cleanability, and aesthetics. For the most part, bedding of this nature is not suited for use with patients having bed sores and the like as they are made from cotton, silk, down, and other fabrics and materials which would readily soil, retain moisture, and otherwise accumulate undesirable residue. For reasons of cleanliness, comfort to the patient, risk from infection and disease, these well known bedding materials in the prior art are typically not used with low air loss mattresses.

Despite the contrary teaching of the prior art, the inventors herein have succeeded in designing and developing an air permeable quilted pad, cover, or sheet for use with a ventilating air mattress which provides a significant improvement in comfort over bedding known in the prior art with a firmness adjustability selectable to suit the individual user. The invention enhances and adapts a ventilating air mattress for general consumer use. The mattress pad, cover, or sheet includes a quilted layer comprised of a pair of layers joined at spaced intervals to form pockets which are inflated by the air escaping from the mattress. A standard quilted construction, with down filler, may be utilized such that the quilted surface forms a layer of "pillows" which are continuously pumped full by the air escaping from the mattress itself. This continual pressurization from the pressurized air permeating the mattress pad provides a uniquely comforting and pleasing effect and the pleasingly cool flow of air over the user's skin evaporates any perspiration to further cool the user. The mattress pad may be provided as part of a semi-permeable mattress cover surrounding the ventilating mattress, or may be provided as a readily removable and washable mattress pad, fitted sheet, or the like.

While the principal advantages and features of the present invention have been described above, a more complete and thorough understanding and appreciation for the invention may be attained by referring to the drawings and description of the preferred embodiment which follow.

DETAILED DESCRIPTION OF THE PREFERRED EMBODIMENT

Figure 1:
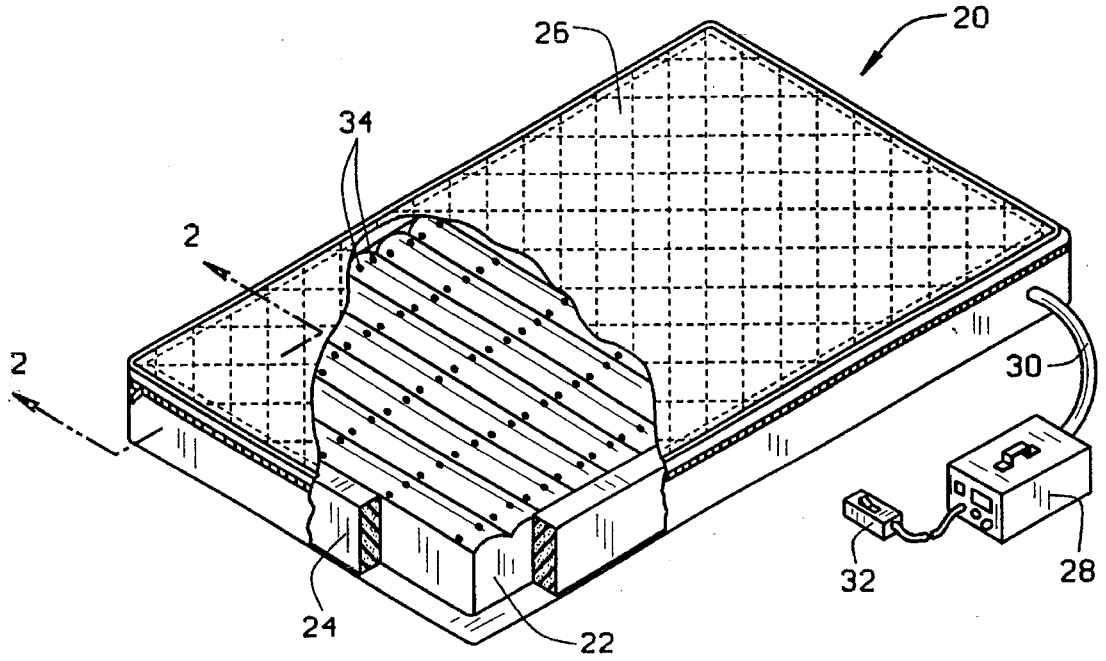
FIG. 1 is an isometric view of the present invention with a portion of the quilted pad cut away to reveal the ventilating air mattress pores and the foam frame.

The ventilating mattress and pad 20 of the present invention is shown generally in FIG. 1 and includes a ventilating air mattress 22 surrounded by a foam frame 24 for support, both of which are enclosed by a quilted mattress cover 26. The ventilating air mattress bladder 22 is inflated by an air pump 28 through a hose connection 30 controlled by a remote control 32. The pressurized air filling air bladder 22 escapes therefrom through a series of holes 34 spaced across the upper surface of the ventilating air mattress bladder 22, as known in the prior art.

Figure 2:
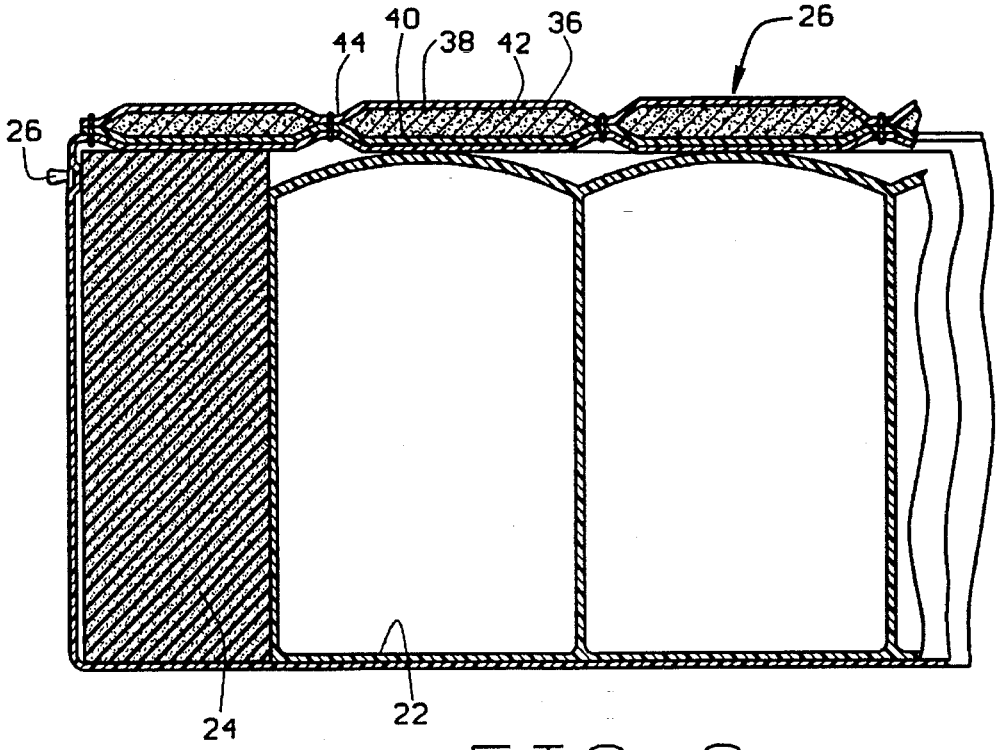
FIG. 2 is a cross-sectional view taken along lines 2—2 in FIG. 1 detailing the pockets of the quilted pad and the inflatable cells of the ventilating air mattress.

As shown in FIG. 2, the quilted mattress pad 26 includes a quilted upper pad portion 36 comprised of an upper layer 38, a lower layer 40, and a layer of padding 42 which may be down or the like therebetween. The upper and lower layers 38, 40 are joined at spaced intervals by stitching 44, as known in the art. As shown in FIG. 1, this stitching 44 may be in a generally orthogonal pattern to form a plurality of pockets across the upper surface of the mattress pad 26. A zipper 46 provides a convenient closure for the semi-permeable mattress pad 26 as depicted in the drawings. In this embodiment, sheets may be fitted over the top of the mattress cover 26 to protect it from soiling during regular use. In an alternate embodiment, the mattress cover 26 may instead be a fitted sheet which slips around the ventilating air mattress 22, 24 which is itself enclosed in a standard mattress pad without quilting. These fitted sheets in this alternate embodiment would then be readily changeable and suitable for typical linen service.

In operation, the remote control 32 may be used to adjust the level of pressurized air produced by pump 28 to thereby adjust the firmness of the mattress and pad combination 20. As the air escapes through the holes in the upper surface of the ventilating mattress bladder, it inflates the quilted pockets formed along the upper surface of the mattress pad cover due to the differential air pressure drop across the lower and upper layers of the quilted cover surface. The down or other suitable filling between the layers helps to keep them separated to enhance this "fluffing" action by the escaping air. Although a standard quilted pattern is shown, other patterns may be more desirable to suit individual tastes and preferences. Although various materials may be used for the upper and lower layers of the quilted cover section, these layers must be air permeable in order to provide the differential pressure drop to produce the fluffing action or inflating action between the two layers. This inflating effect may be adjusted by using materials having different vapor permeability for the upper and lower layer. Furthermore, enhanced moisture protection for the mattress pad may be provided by utilizing different materials such as polytetrafluorethylene or the like.

There are various changes and modifications which may be made to the invention as would be apparent to those skilled in the art. However, these changes or modifications are included in the teaching of the disclosure, and it is intended that the invention be limited only by the scope of the claims appended hereto.

What is claimed is:

1. A mattress and cover combination comprising a ventilated air mattress having an upper portion which releases a flow of air therethrough, and a cover for overlying at least said air releasing upper portion of said ventilated air mattress, said cover having at least two separated layers of air permeable material so that said flow of air inflates said separated layers to create a pillowing effect in said separated layers over said upper portion.

2. The mattress and cover combination of claim 1 further comprising means for joining said separated layers at a plurality of spaced intervals across said upper portion.

3. The mattress and cover combination of claim 2 wherein said joining means comprises rows of stitching.

4. The mattress and cover combination of claim 3 wherein said rows of stitching are arranged in a substantially orthogonal pattern to thereby create a plurality of pockets in said cover.

5. The mattress and cover combination of claim 4 further comprising a layer of cushioning material located between said layers, said cushioning material thereby providing an increased pillowing effect at least when said air is not flowing.

6. The mattress and cover combination of claim 5 wherein said cover totally encloses said ventilated air mattress and thereby provides a semi-permanent covering therefor.

7. The mattress and cover combination of claim 5 wherein said cover is a removable mattress cover adapted for ready removal from said ventilated air mattress.

8. The mattress and cover combination of claim 7 wherein said cover is fitted to said ventilated air mattress.

9. The mattress and cover combination of claim 5 further comprising means for varying the rate of air flow to thereby vary the firmness of said ventilated air mattress.

10. A mattress and cover combination comprising:

a ventilated air mattress, and a cover for said ventilated air mattress, said cover having a plurality of multi-layered pockets, said pockets being located on said cover so that air released from said ventilated air mattress inflates said pockets to thereby create a pillowing effect.

11. The mattress and cover combination of claim 10 wherein said pockets are made of air permeable material.

12. The mattress and cover combination of claim 11 further comprising a layer of cushioning material located in said cover to thereby provide an increased pillowing effect.

13. The mattress and cover combination of claim 12 wherein pockets are defined by rows of stitching through said cover.

14. The mattress and cover combination of claim 12 wherein said cover totally encloses said ventilated air mattress and thereby provides a semi-permanent covering therefor.

15. The mattress and cover combination of claim 12 wherein said cover is a removable mattress cover adapted for ready removal from said ventilated air mattress.

16. The mattress and cover combination of claim 12 further comprising means for varying the rate of air flow to thereby vary the firmness of said ventilated air mattress.

17. A mattress having an air inflatable, pillowed upper surface comprising a low air loss bladder, said bladder having a plurality of holes across its upper surface through which a flow of air escapes, and a mattress cover over at least a portion of said upper surface, said mattress cover having a plurality of air inflatable pillows, and means for inflating said air inflatable pillows.

* * * * *